US006313419B1

(12) United States Patent
Amore

(10) Patent No.: US 6,313,419 B1
(45) Date of Patent: Nov. 6, 2001

(54) PRESSURE RESPONSIVE ELECTRICAL SWITCH

(75) Inventor: Alan G. Amore, Cumberland, RI (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/618,859

(22) Filed: Jul. 18, 2000

(51) Int. Cl.[7] ..... H01H 35/26; H01H 5/00

(52) U.S. Cl. ..... 200/83 P; 200/83 N; 200/302.1; 200/405

(58) Field of Search ..... 200/83 J, 83 P, 200/83 N, 402–413, 275–284, 302.1–302.3, 243

(56) References Cited

U.S. PATENT DOCUMENTS

| | | | | |
|---|---|---|---|---|
| 3,268,683 | * | 8/1966 | Palmer | 200/83 N |
| 3,573,410 | * | 4/1971 | Budzich et al. | 200/83 P |
| 4,121,073 | * | 10/1978 | Bileski et al. | 200/83 P |
| 4,243,888 | * | 1/1981 | Place | 200/83 P |
| 4,616,114 | * | 10/1986 | Strasser | 200/83 J |
| 5,004,876 | * | 4/1991 | Sogge et al. | 200/83 P |
| 5,822,173 | * | 10/1998 | Dague et al. | 200/83 Q X |
| 6,049,047 | * | 4/2000 | Miyashima et al. | 200/284 |

* cited by examiner

*Primary Examiner*—J. R. Scott
(74) *Attorney, Agent, or Firm*—Russell E. Baumann; Frederick J. Telecky, Jr.

(57) ABSTRACT

A pressure responsive electrical switch (10) has a base (12) formed with a bottom wall (12*a*) having a top surface (12*b*) formed with a generally disc seat (12*c*). A recess (12*d*) is formed in the bottom wall through the top surface within the area defined by the disc seat and with first and second bores (12*e*) formed through the bottom wall aligned with the recess. Integrally formed combination terminal and movable contact arm members (14) each have a first portion (14*a*) serving as a respective terminal and a second, movable contact arm portion (14*b*) swaged to an attenuated thickness. The movable contact arm portions extend side by side transversely across the bottom surface of the recess in generally opposite directions and with a free distal contact end portion (14*d*) extending slightly above a disc seat formed on the top surface. An electrically conductive, snap-acting disc (16) is disposed on the disc seat out of engagement with the contact end portions (14*d*) when the disc placed in pressure receiving communication with a fluid pressure source to be monitored is in one dished configuration at pressures below a selected actuation level and in electrical engagement with the contact end portions when the pressure of the fluid exceeds the actuation level. An alternate embodiment includes a calibration beam (34*a*) on at least one of first and second combination terminal, movable contact arm members (34) to allow adjustment of the release pressure level of the snap acting disc.

5 Claims, 3 Drawing Sheets

PRESSURE RESPONSIVE ELECTRICAL SWITCH

FIELD OF THE INVENTION

This invention relates generally to fluid pressure responsive electrical switches and more particularly to such switches used to control on/off cycles of automatic air conditioning compressors.

BACKGROUND OF THE INVENTION

Switches presently used for this purpose typically comprise a pressure responsive snap acting disc member mounted in a housing with one face of the disc in fluid receiving communication with the fluid being monitored. The disc, upon snapping from one dished configuration to an opposite dished configuration, is adapted to transfer motion to a pin slidably disposed on the opposite face side of the disc. The pin extends between the disc and an elongated movable contact arm cantilever mounted in a switch chamber within the housing. A movable electrical contact is mounted on the movable contact arm at the distal free end thereof and is adapted to move into and out of engagement with a stationary contact mounted in the housing. The movable contact arm and the stationary contact arm are attached to respective terminals mounted in spaced apart relation on the housing as by riveting or welding.

Designs of the type described have inherent quality concerns due to the relatively large number of operations involved in manufacturing the switches such as pin gauging, pin length sizing, riveting and so on. Another limitation of the prior art switches relates to the type of switching mechanism employed. Once the disc has snapped causing the motion transfer pin to force the movable contact arm toward the stationary contact and into engagement with the stationary contact, the movable contact arm becomes, in effect, a simply supported beam and concomitantly the stresses in the movable contact arm become very high, relatively to the yield strength of the material used for the movable contact arm, generally beryllium copper (yield strength of approximately 140,000 psi).

SUMMARY OF THE INVENTION

An object of the present invention is the provision of a pressure responsive electrical switch particularly useful for use with automatic air conditioning units for cycling, the AC compressors on and off which is free of the prior limitations noted above. Another object of the invention is to provide a pressure responsive electrical switch which is less expensive to manufacture than prior art switches while at the same time providing such a switch which has fewer quality concerns. Yet another object of the invention is the provision of a pressure responsive switch which has improved reliability and improved longevity.

Briefly stated, a pressure responsive electrical switch made in accordance with the invention comprises a base member formed of electrically insulative material having a bottom wall with opposite first and second face surfaces formed with a generally circular disc seat lying in a plane on the first face surface. A recess is formed in the first face surface within the area defined by the disc seat with first and second bores extending through the bottom wall aligned with the recess. First and second combination terminals and movable contact arms, each formed from a single piece of suitable material, such as beryllium copper or stainless steel, has a terminal section with a selected terminal thickness frictionally received in a respective bore. An attenuated, movable arm section extends from the terminal section and has a generally L-shaped configuration with a portion extending transversely over and spaced from the bottom surface of the recess with a free distal end portion disposed above the plane in which the disc seat lies. The transversely extending portions of the movable contact arms extend in directions generally parallel and opposite to one another. An electrically conductive snap acting, dish shaped disc is disposed on the disc seat with the distal end portions of the movable contact arms out of engagement with the disc when the disc is in a downwardly concave configuration and in engagement with the disc when the disc is in a downwardly convex configuration to close a circuit path between the first and second terminal sections. A flexible sheet is placed over the disc to maintain the disc at the disc seat and form a fluid seat between a port fitting receiving fluid whose pressure is to be monitored and the disc and disc seat.

In an alternate embodiment, a calibration beam is provided for one or both combination terminal, movable contact arm members to permit adjustment of the release pressure of the snap acting disc, i.e., the pressure at which the disc snaps back to its normal downwardly concave configuration.

Additional objects and features of the invention will be set forth in part in the description which follows and in part will be obvious from the description. The objects and advantages of the invention may be realized and attained by means of the structures particularly pointed out in the appended claims.

BRIEF DESCRIPTION OF THE DRAWINGS

The accompanying drawings, incorporated in and constituting a part of the specification, illustrate preferred embodiments of the invention and, together with description, serve to explain the objects, advantages and principles of the invention. In the drawings.

DETAILED DESCRIPTION OF THE PREFERRED EMBODIMENT

Figure 1:
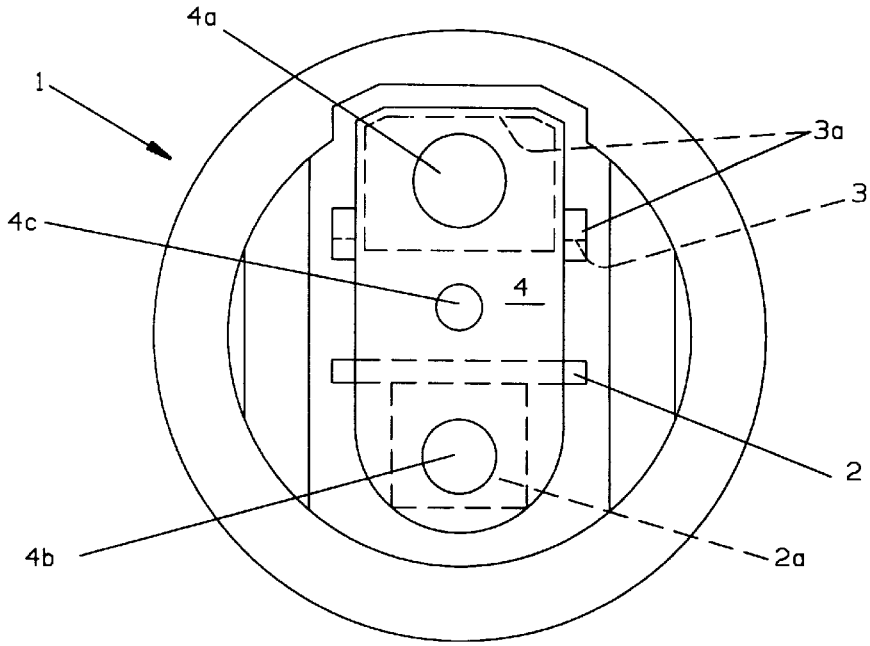
PRIOR ART FIG 1
FIG. 1 is a top view of the base portion of a pressure responsive electrical switch made in accordance with the prior art.
Figure 2:
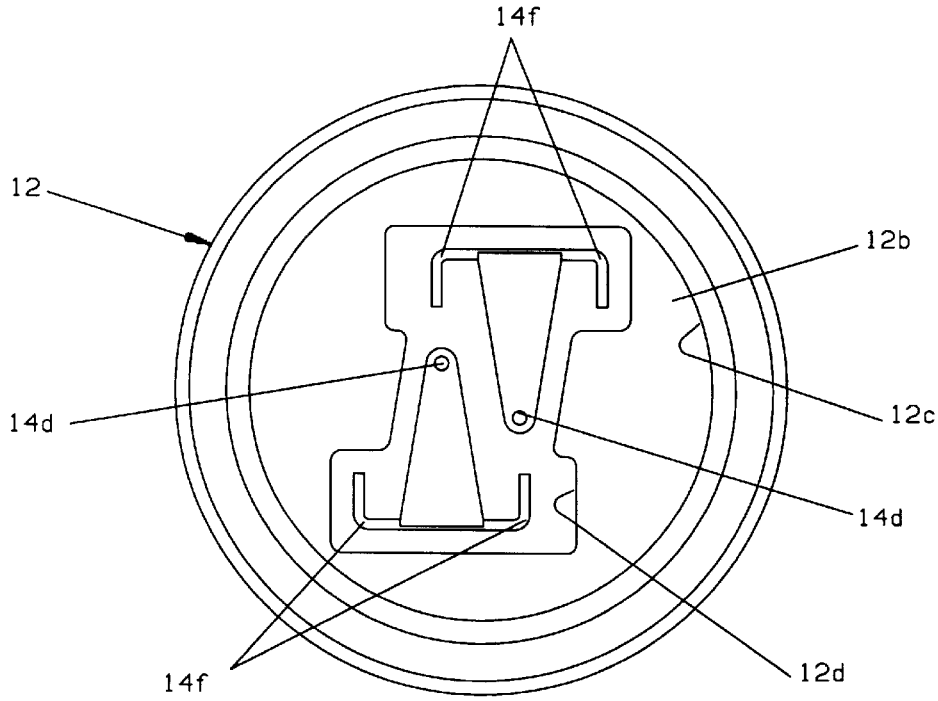
FIG. 2 is a top view, similar to FIG. 1, of a pressure responsive electrical switch made in accordance with the invention.
Figure 3:
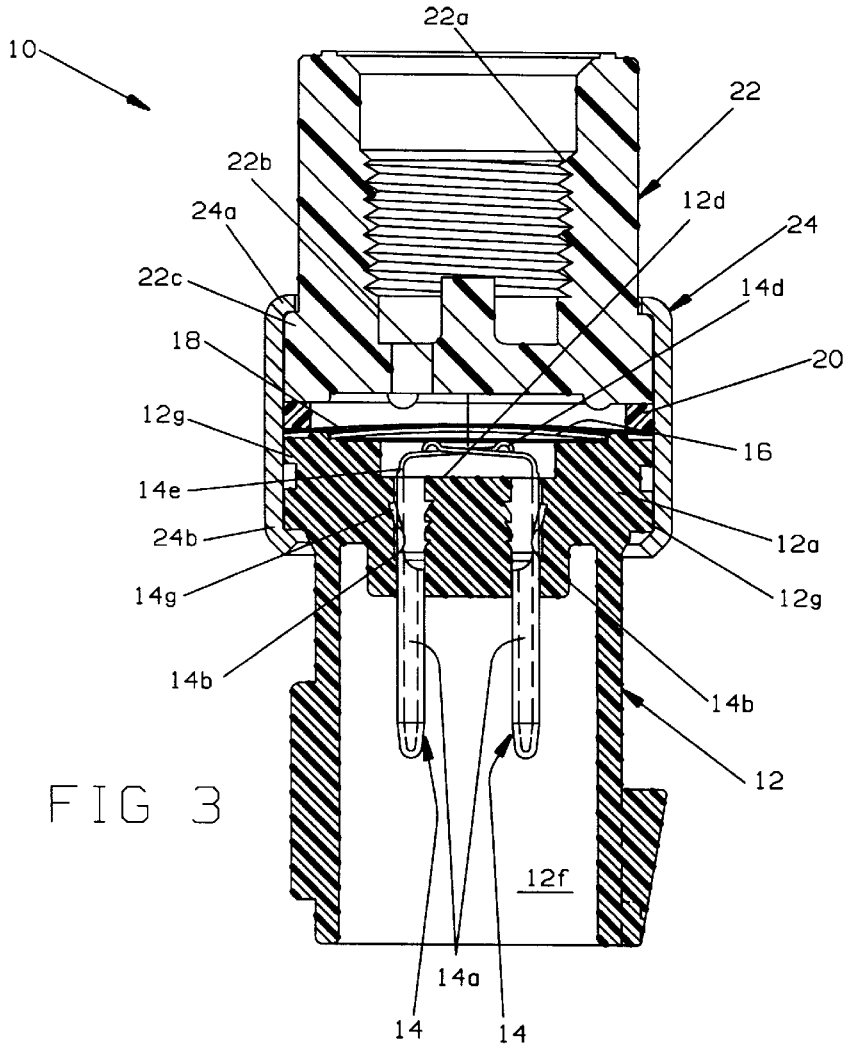
FIG. 3 is an elevational cross sectional view taken through a pressure responsive electrical switch made in accordance with the invention.
Figure 4:
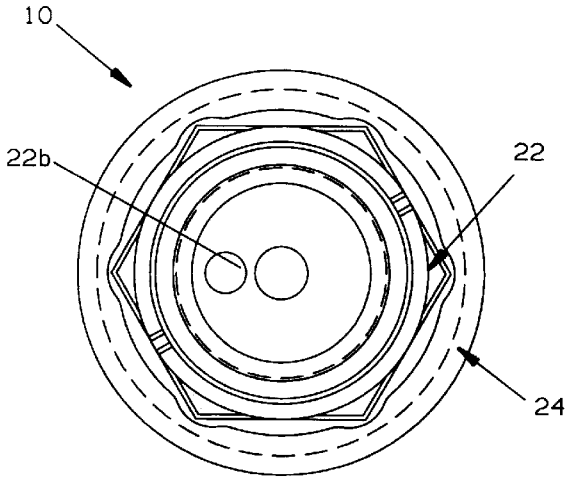
FIG. 4 is a top plan view of the FIG. 3 switch.
Figure 5:
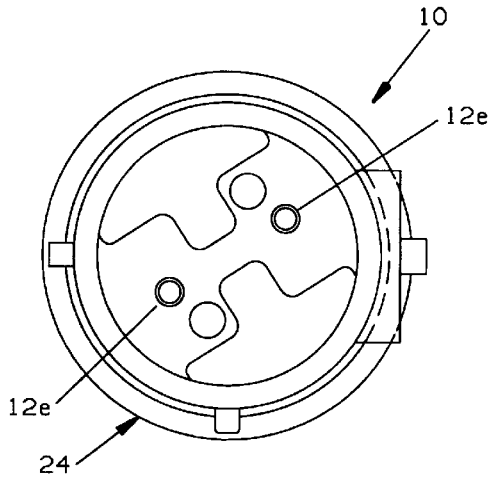
FIG. 5 is a bottom plan view of the FIG. 3 switch.
Figure 8:
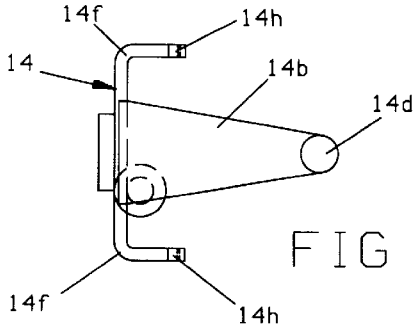
FIGS. 6, 7 and 8 are enlarged front, side and top views respectively of one of the combination terminal, movable contact arm members.

The base portion of a prior art pressure responsive electrical switch 1 is shown in FIG. 1. Such switches used to cycle a compressor typically include a base formed of suitable electrically insulative material having a bottom wall with first and second terminals 2, 3 respectively, extending therethrough connected as by riveting or welding to electrically conductive plate members 2*a*, 3*a* respectively. A movable contact arm 4 is mounted to plate member 3*a* as by riveting or welding at 4*a* and extends therefrom in cantilever fashion. The distal free end of movable contact arm 4 is provided with a movable contact attached to the lower surface of arm 4 by suitable means such as welding using slug 4*b*. The movable contact is adapted to move into and out of engagement with a stationary contact (not shown) mounted on plate 2*a*. Movable contact arm 4 is normally biased away from the stationary contact. A pressure responsive dish shaped disc member, not shown, is adapted to be placed in fluid pressure communication with the evaporator fluid and is mounted above movable contact arm 4 with a motion transfer pin (not shown) slidably disposed between the disc and the force receiving protrusion 4*c*. Upon snapping of the disc at a predetermined pressure level, the pin will drive the movable contact so that the movable contact moves into electrical engagement with the stationary contact to close a circuit path. When the disc snaps back to its original configuration upon a predetermined decrease in fluid pressure, movable contact arm 4 moves away from the stationary contact to open the circuit path.

As noted above, among the quality concerns related to such switches include the need to provide a transfer pin of a precise length to ensure the proper transfer of motion from the snap acting disc to the movable arm as well as a pin which is freely slidable in the bore of a support mounting the pin. Additionally, each welding or riveting operation not only adds to assembly time and therefore cost but also increases the changes of a defect. The design also has the inherent limitation in that the movable arm, upon being driven to the closed contact position, acts as a simply supported beam with attendant stress levels which are high relative to the yield strength of the material, e.g., beryllium copper, to provide the desired characteristics of electrical conductivity and spring material, thus adversely affecting the expected life of the switch.

With reference to FIGS. 2–9, a pressure responsive switch 10 made in accordance with the preferred embodiment of the invention comprises a generally cylindrical base 12 of suitable electrically insulative moldable material such as glass fiber reinforced Nylon. Base 12 is formed with a bottom wall 12*a* having a top surface 12*b* formed with a generally circular disc seat 12*c*. A recess 12*d* is formed in the top surface within the area defined by the disc seat and with first and second spaced apart bores 12*e* formed through bottom wall 12*a*.

Figure 9:
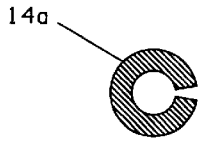
FIG. 9 is a further enlarged cross sectional view taken through the terminal portion of the FIGS. 6–8 member.
Figure 6:
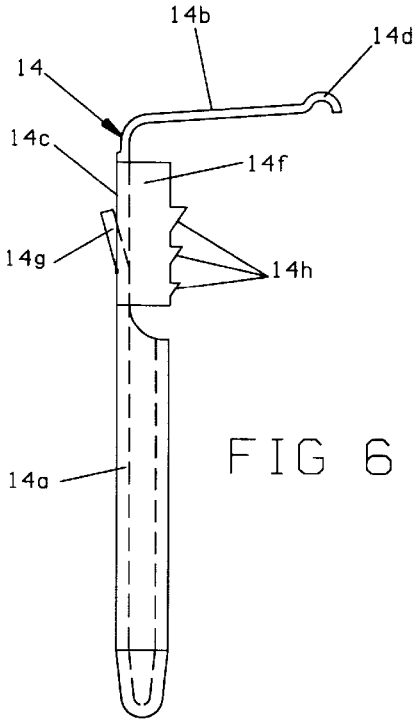
Figure 7:
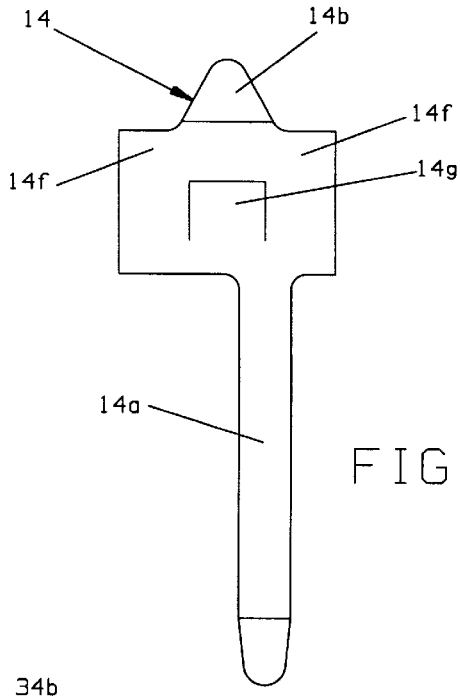

First and second combination terminal, movable contact arm, contact members 14, formed of suitable electrically conductive material having good spring characteristics, such as beryllium copper alloy 25 or type 302 stainless steel are each received in a respective bore 12*e* and extend from a shroud portion 12*f* of the base into recess 12*d*. Each member 14 is formed from a single piece of material having a terminal end portion 14*a* of a selected thickness, such as 0.015 inches thick, sufficient to provide suitable rigidity, preferably rolled into a generally circular configuration as seen in FIG. 9, an intermediate portion 14*c* for forming an interference fit in bores 12*e,* and a portion 12*b* swaged to a selected attenuated thickness to provide a flexible arm portion, for example, swaged to an attenuated thickness of approximately 0.0105 inches, providing a suitable spring temper. Preferably, members 14 are provided with a suitable electrically conductive coating such as a nickel flash followed by silver plating. Flexible arm portions 14b are deformed into a generally L-shaped configuration with one leg of the L-shaped extending transversely across the bottom surface of the recess 12*d*. Preferably, the distal end portion of each flexible arm portion 14*b* is formed into a contact protrusion 14*d*. The second leg 14*e* of the L-shape extends from intermediate portion 14*c*. Laterally extending side portions 14*f* preferably have a tab 14*g* and a plurality of teeth 14*g* projecting therefrom to lock into the base material when the members are pressed into bores 12*e*. Members 14 are oriented so that movable contact arm portion 14*b* extend side by side in opposite directions.

A dished shaped snap-acting disc 16 formed of electrically conductive material, such as stainless steel, and preferably having at least a central portion of the normally downwardly facing concave side coated with a precious metal, such as gold, is received on disc seat 12*c* with a flexible sheet 18 of suitable material such as Kapton preferably with outer Teflon layers, disposed over the disc and extending radially outwardly beyond the disc essentially to the outer periphery of base 12. An annular gasket 20 of suitable material such as hydrogenated nytrilebutadene rubber is placed over and compressed against the flexible sheet by means of a crimp cup 24 to be discussed to provide a fluid seal as well as to maintain disc 16 in its seat.

A port fitting 22 formed of a 30% glass fiber reinforced Nylon or other suitable material has an internally threaded coupling portion 22*a* with a bore 22*b* formed through a bottom wall. Port fitting 22 is received on gasket 20 and a metallic tubular crimp cup is crimped at 24*a*, 24*b* respectively, over radially outwardly extending flanges 22*c* of port fitting 22 and 12*g* of base 12 while the port fitting and base are held together with a selected force.

In assembling pressure responsive switch 10, the combination terminal, movable contact, contact members 14 are press fitted into bores 12*e* until contact portions 14*d* are disposed in a plane slightly higher than the plane in which the disc seat lies, typically up to 0.004 inches, so that a downwardly concave disc seated on the disc seat is normally out of engagement with contact portions 14*d*. During assembly, the contact portions 14*d* are deflected to a position corresponding to where the disc surface would be in the actuated position and the force required for such deflection is measured. A disc is then selected having a cooperating pressure profile to achieve the desired product pressure actuation and release levels, e.g., 45 psig actuation 22 psig release. In making switches according to the invention, a typical force of 125 grams is exerted by contact portions at approximately 0.007 inches of deflection.

Upon assembly, when the disc is exposed to a selected level of fluid pressure through flexible layer 18, the disc snaps from a downwardly facing concave configuration to a downwardly facing convex configuration and into engagement with contact portions 14*d* with a sliding motion. The side by side, transversely extending movable contact arms, even after contact engagement, continue to act as cantilever mounted beams with a lower stress profile than the prior art discussed above. This stress level can easily be kept to only a fraction of the material yield strength of members 14. For example, the calculated Von Mises stress levels for displacement of 0.012 inches of a movable contact arm of 0.010 inches thick resulted in a maximum stress of less than 50,000 psi, well below the material yield strength of approximately 140,000 psi.

Figure 10:
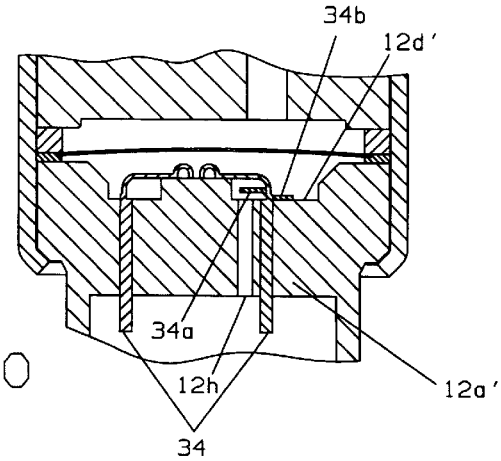
FIG. 10 is a broken away cross sectional view showing the switching chamber portion of an alternate embodiment.

With reference to FIG. 10, an alternate embodiment is shown in which at least one of the combination terminal, movable contact arm members 34 is shown with a calibration beam 34*a* extending laterally from the main body portion of member 34 over a hole 12*h* in bottom wall 12*a*'. A calibration beam 34*a* has an offset portion 34*b* which extends beyond member 34 along the bottom surface of recess 12*d'*. Calibration beam 34*a* can be accessed through hole 12*h* for applying a selected force to permanently deflect the beam to move the distal end 34*d* closer to the disc surface raising its spring "back force" on the disc after the disc has snapped to its actuated configuration. The higher back force results in an increase in the release or cut-out pressure thereby making the release pressure calibratable.

Although the invention has been described with regard to a specific preferred embodiment thereof, variations and modifications will become apparent to those skilled in the art. It is therefore the intention that the appended claims be interpreted as broadly as possible in view of the prior art to include all such variations and modifications.

What is claimed:

1. A condition responsive electrical switch comprising an electrically insulative base member having a bottom wall with opposed first and second face surfaces formed with a generally circular disc seat generally lying in a plane on the first face surface, a recess having a bottom surface formed in the first face surface within the disc seat, first and second bores extending through the wall aligned with the recess, first and second integrally formed combination terminal and movable contact arm members each having an elongated terminal portion having a first section with a selected thickness received in one of the respective bores and frictionally engaging the base member within the respective bore, each respective contact arm having a second movable arm portion having an attenuated thickness, the combination members being formed in a generally L-shaped configuration with the movable contact arm portion extending transversely over and spaced from the bottom surface of the recess with a free distal end portion disposed above the plane in which the disc seat lies, the transversely extending portions of the combination terminal and movable contact arm members extending side by side in spaced apart relation and in generally opposite directions to one another, an electrically conductive snap acting dish shaped disc member disposed on the disc seat, the disc member being movable between one dished configuration in which the free distal end portions of the movable contact arms are out of engagement with the disc member and a second oppositely dished configuration in which the disc member engages the distal end portions of the movable contact arms, biasing the distal end portions downwardly and closing a circuit path therebetween, and a seating element disposed over at least a portion of the disc in the disc seat.

2. A condition responsive electrical switch according to claim 1 in which the seating element disposed over the disc seat comprises a flexible sheet of Kapton.

3. A condition responsive electrical switch according to claim 2 in which a port fitting is coupled to the base forming a fluid pressure chamber between the port fitting and the flexible sheet of Kapton.

4. A condition responsive electrical switch according to claim 1 in which the first and second integrally formed combination terminal and movable contact arms are each formed of a beryllium copper alloy in which the terminal portion is approximately 0.015 inches thick with the second attenuated section swaged to a thickness approximately 0.0105 inches.

5. A condition responsive electrical switch according to claim 1 in which the first and second integrally formed combination terminal and movable contact arms are each formed of a stainless steel alloy in which the terminal portion is approximately 0.015 inches thick with the second attenuated section swaged to a thickness approximately 0.0105 inches.

* * * * *